US008933956B2

(12) United States Patent
Kang

(10) Patent No.: US 8,933,956 B2
(45) Date of Patent: Jan. 13, 2015

(54) METHOD AND APPARATUS FOR RGB COLOR SPACE GAMUT CONVERSION, AND LIQUID CRYSTAL DISPLAY DEVICE

(75) Inventor: Chih-tsung Kang, Guangdong (CN)

(73) Assignee: Shenzhen China Star Optoelectronics Technology Co., Ltd, Shenzhen, Guangdong (CN)

( * ) Notice: Subject to any disclaimer, the term of this patent is extended or adjusted under 35 U.S.C. 154(b) by 224 days.

(21) Appl. No.: 13/510,354

(22) PCT Filed: Mar. 31, 2012

(86) PCT No.: PCT/CN2012/073369

§ 371 (c)(1),
(2), (4) Date: May 17, 2012

(87) PCT Pub. No.: WO2013/131295

PCT Pub. Date: Sep. 12, 2013

(65) Prior Publication Data

US 2013/0235063 A1 Sep. 12, 2013

(30) Foreign Application Priority Data

Mar. 8, 2012 (CN) ..... 2012 1 0059415

(51) Int. Cl.
*G09G 5/02* (2006.01)

(52) U.S. Cl.
USPC ..... 345/590

(58) Field of Classification Search
CPC ..... H04N 1/60; H04N 1/6025; G06T 11/001
See application file for complete search history.

(56) References Cited

U.S. PATENT DOCUMENTS

2010/0091034 A1 * 4/2010 Matsumoto et al. ..... 345/601

OTHER PUBLICATIONS

Dongil Han, Real-Time Color Gamut Mapping Method for Digital TV Display Quality Enhancement, 2004, IEEE.*
Henry R Kang, Computational Color Technology, 2006, eISBN: 9780819481085, p. 152-182.*

* cited by examiner

*Primary Examiner* — Kee M Tung
*Assistant Examiner* — Xin Sheng
(74) *Attorney, Agent, or Firm* — Andrew C. Cheng

(57) ABSTRACT

The present invention discloses a method for RGB color space gamut conversion, including: projecting any point o in RGB color space having source graphic data onto points N, M, mapped to coordination points in source cube; projecting point o' corresponding to point o onto points N', M', mapped to coordination points in target cube; based on coordination points in target cube, computing points N', M'; based on points N' and M', computing point o' in target cube corresponding to point o in RGB color space having source graphic data; and computing target color after color conversion from any point in source graphic data. The invention also discloses an apparatus for RGB color space gamut conversion and an LCD device. With this, it is possible to perform color conversion in RGB color space, adjust color performance of output in hue and color purity, and accentuate specific colors.

3 Claims, 4 Drawing Sheets

METHOD AND APPARATUS FOR RGB COLOR SPACE GAMUT CONVERSION, AND LIQUID CRYSTAL DISPLAY DEVICE

BACKGROUND OF THE INVENTION

1. Field of the Invention

The present invention relates to the field of color conversion, and in particular to a method and apparatus for RGB color space gamut conversion and liquid crystal display device.

2. The Related Arts

Essentially, liquid crystal display (LCD) devices have the color dispersion problem. In addition, the use of photo-resistors and light sources will make the color performance on LCD very different from what human eyes experience in reality.

Color conversion is a technique to convert a color from one color space to another color space. There are many techniques to realize the color space conversion, such as, model method, neural network algorithm, and so on, wherein model method involves complicated computation process to find solutions and the conversion result is not always satisfactory, while the neural network algorithm approach requires a large amount of experiments, with each experiment requiring a long time. Furthermore, the above two approaches for color conversion also result in a large discrepancy between the LCD color performance and the actual color of an object.

Therefore, it is imperative to develop color conversion techniques to make the color performance of the LCD closer to, or even brighter and more vivid than, the actual color of the object.

SUMMARY OF THE INVENTION

The technical issue to be addressed by the present invention is to provide a method and apparatus for RGB color space gamut conversion and a liquid crystal display device, which is easier to construct a reverse conversion model, and implement the conversion algorithm with fast computation so that the color performance can be closer to the actual object color or closer to expected effect than the actual object color.

An exemplary embodiment of the present invention provides a method for RGB color space gamut conversion, including the following steps:

inputting RGB-based source graphic data;

dividing the RGB color space having all the colors corresponding to source graphic data into m*n*k source cubes, where 0<m, n, k<256;

defining eight vertices of each source cube as a, b, c, d, e, f, g, and h, where a=(aR, aG, aB), b=(bR, bG, bB), . . . , h=(hR, hG, hB), and defining eight vertices of the target cube converted from source cube through gamut conversion as a', b', c', d', e', f', g', and h', where a'=(aR', aG', aB'), b=(bR', bG', bB'), . . . , h=(hR', hG', hB');

projecting any point o in the RGB color space having all the colors corresponding to source graphic data onto point N on the plane formed by four vertices e, f, g and h of source cube, with the projected point N corresponding to the four coordination points i, j, k and l on the four sides of the plane formed by four vertices e, f, g and h of source cube, where i=(iR, iG, iB), j=(jR, jG, jB), k=(kR, kG, kB), l=(lR, lG, lB); projecting any point o in the RGB color space having all the colors corresponding to source graphic data onto point M on the plane formed by four vertices a, b, c and d of source cube, with the projected point M corresponding to the four coordination points p, q, r and s on the four sides of the plane formed by four vertices a, b, c and d of source cube, where p=(pR, pG, pB), q=(qR, qG, qB), r=(rR, rG, rB), s=(sR, sG, sB);

defining the point in the target cube corresponding to point o in the RGB color space having all the colors corresponding to source graphic data as point o' and projecting point o' in the target cube onto point N' on the plane formed by four vertices e', f', g' and h' of target cube, with the projected point N' corresponding to the four coordination points i', j', k' and l' on the four sides of the plane formed by four vertices e', f', g' and h' of target cube, where l'=(iR', iG', iB'), j'=(jR', jG', jB'), k'=(kR', kG', kB'), l'=(lR', lG', lB'); projecting point o' in the target cube onto point M' on the plane formed by four vertices a', b', c' and d' of target cube, with the projected point M' corresponding to the four coordination points p', q', r' and s' on the four sides of the plane formed by four vertices a', b', c' and d' of target cube, where p'=(pR', pG', pB'), q'=(qR', qG', qB'), r'=(rR', rG', rB'), s'=(sR', sG', sB');

based on four coordination points i, j, k and l on the four sides of the plane formed by four vertices e, f, g and h of source cube, computing four coordination points i', j', k' and l' on the four sides of the plane formed by four vertices e', f', g' and h' of target cube; based on four coordination points p, q, r and s on the four sides of the plane formed by four vertices a, b, c and d of source cube, computing four coordination points p', q', r' and s' on the four sides of the plane formed by four vertices a', b', c' and d' of target cube;

based on the computed four coordination points i', j', k' and l' on the four sides of the plane formed by four vertices e', f', g' and h' of target cube, computing point N' projected by point o' on the plane formed by four vertices e', f', g' and h' of target cube; based on the computed four coordination points p', q', r' and s' on the four sides of the plane formed by four vertices a', b', c' and d' of target cube, computing point M' projected by point o' on the plane formed by four vertices a', b', c' and d' of target cube;

based on the computed point N' on the plane formed by four vertices e', f', g' and h' of target cube and the computed point M' on the plane formed by four vertices a', b', c' and d' of target cube, computing the data of point o' in the target cube corresponding to point o in the RGB color space having all the colors corresponding to source graphic data; and outputting or preserving the data of point o' in the target cube corresponding to point o in the RGB color space having all the colors corresponding to source graphic data, and the data of all points o's in the target cube forming the target color after the color gamut conversion;

wherein the step of computing four coordination points i', j', k' and l' on the four sides of the plane formed by four vertices e', f', g' and h' of target cube based on four coordination points i, j, k and l on the four sides of the plane formed by four vertices e, f, g and h of source cube, and computing four coordination points p', q', r' and s' on the four sides of the plane formed by four vertices a', b', c' and d' of target cube based on four coordination points p, q, r and s on the four sides of the plane formed by four vertices a, b, c and d of source cube further including the following steps:

defining the basic unit of R, G, B of each source cube as XR, XG, and XB, where $$X_R=b_R-a_R=c_R-d_R=f_R-e_R=g_R-h_R$$

$$X_G=d_G-a_G=c_G-b_G=h_G-e_G=g_G-f_G$$

$$X_B=e_B-a_B=h_B-d_B=g_B-c_B=f_B-b_B$$

based on a first-type equation, a second-type equation, a third-type equation and a fourth-type equation between four coordination points i, j, k and l on the four sides of the plane formed by four vertices e, f, g and h of source cube and four coordination points i', j', k' and l' on the four sides of the plane formed by four vertices e', f', g' and h' of target cube, computing four coordination points i', j', k' and l' on the four sides of the plane formed by four vertices e', f', g' and h' of target cube, where the first-type, second-type, third-type and fourth-type equations expressed as following respectively:

$$i'=(i_R', i_G', i_B')\ k'=(k_R',k_G',k_B')$$

$$l_R'=e_R'+(i_R-e_R)/X_R*(f_R'-e_R')\ k_R'=e_R'+(k_R-e_R)/X_R*(h_R'-e_R')$$

$$l_G'=e_G'+(i_G-e_G)/X_G*(f_G'-e_G')\ k_G'=e_G'+(k_G-e_G)/X_G*(h_G'-e_G')$$

$$l_B'=e_B'+(i_B-e_B)/X_B*(f_B'-e_B')\ k_B'=e_B'+(k_B-e_B)/X_B*(h_B'-e_B')$$

$$j'=(j_R', j_G', j_B')\ l'=(l_R', l_G', l_B')$$

$$j_R'=h_R'+(j_R-h_R)/X_R*(g_R'-h_R')\ l_R'=f_R'+(l_R-f_R)/X_R*(g_R'-f_R')$$

$$j_G'=h_G'+(j_G-h_G)/X_G*(g_G'-h_G')\ l_G'=f_G'+(l_G-f_G)/X_G*(g_G'-f_G')$$

$$j_B'=h_B'+(j_B-h_B)/X_B*(g_B'-h_B')\ l_B'=f_B'+(l_B-f_B)/X_B*(g_B'-f_B')$$

based on a fifth-type equation, a sixth-type equation, a seventh-type equation and a eighth-type equation between four coordination points p, q, r and s on the four sides of the plane formed by four vertices a, b, c and d of source cube and four coordination points p', q', r' and s' on the four sides of the plane formed by four vertices a', b', c' and d' of target cube, computing four coordination points p', q', r' and s' on the four sides of the plane formed by four vertices a', b', c' and d' of target cube, where the fifth-type, sixth-type, seventh-type and eighth-type equations expressed as following respectively:

$$p'=(p_R', p_G', p_B')\ r'=(r_R', r_G', r_B')$$

$$p_R'=a_R'+(p_R-ae_R)/X_R*(b_R'-a_R')\ r_R'=a_R'+(r_R-a_R)/X_R*(d_R'-a_R')$$

$$p_G'=a_G'+(p_G-a_G)/X_G*(b_G'-a_G')\ r_G'=a_G'+(r_G-a_G)/X_G*(d_G'-a_G')$$

$$p_B'=a_B'+(p_B-a_B)/X_B*(b_B'-a_B')\ r_B'=a_B'+(r_B-a_B)/X_B*(d_B'-a_B')$$

$$q'=(q_R', q_G', q_B')\ s'=(s_R', s_G', s_B')$$

$$q_R'=d_R'+(q_R-d_R)/X_R*(c_R'-d_R')\ s_R'=b_R'+(s_R-b_R)/X_R*(c_R'-b_R')$$

$$q_G'=d_G'+(q_G-d_G)/X_G*(c_G'-d_G')\ s_G'=b_G'+(s_G-b_G)/X_G*(c_G'-b_G')$$

$$q_B'=d_B'(q_B-d_B)/X_B*(c_B'-d_B')\ s_B'b_B'+(s_B-b_B)/X_B*(c_B'-b_B')$$

wherein the step of computing the data of point o' in the target cube corresponding to point o in the RGB color space having all the colors corresponding to source graphic data, based on the computed point N' on the plane formed by four vertices e', f', g' and h' of target cube and the computed point M' on the plane formed by four vertices a', b', c' and d' of target cube further includes the steps:

defining $\overline{NO}$ as the distance between point N on the plane formed by four vertices e, f, g, and h of source cube and any point o in the source cube, $\overline{MO}$ as the distance between point M on the plane formed by four vertices a, b, c, and d of source cube and any point o in the source cube, $\overline{N'O'}$ as the distance between point N' on the plane formed by four vertices e', f', g', and h' of target cube and point o' in the target cube corresponding to any point o, and $\overline{M'O'}$ as the distance between point M' on the plane formed by four vertices a', b', c', and d' of target cube and point o' in the target cube corresponding to any point o;

based on a ninth-type equation among point N' on the plane formed by four vertices e', f', g', and h' of target cube, point M' on the plane formed by four vertices a', b', c', and d' of target cube and point o' in the target cube corresponding to any point o, computing the data of point o' in the target cube corresponding to point o in the RGB color space having all the colors corresponding to source graphic data, wherein the ninth-type equation is:

$$O_R' = N_R' + (N_R' - M_R')^* \frac{\overline{NO}}{\overline{NO}+\overline{MO}}$$

$$O_G' = N_G' + (N_G' - M_G')^* \frac{\overline{NO}}{\overline{NO}+\overline{MO}}$$

$$\frac{\overline{MO}}{\overline{NO}} = \frac{\overline{M'O'}}{\overline{N'O'}}\quad O_B' = N_B' + (N_B' - M_B')^* \frac{\overline{NO}}{\overline{NO}+\overline{MO}}$$

wherein m*n*k source cubes are the m*n*k source right cubes, with m, n and k all having equal values;

wherein m*n*k source cubes are the m*n*k source rectangular cuboids, with two of m, n and k having equal values.

Another exemplary embodiment of the present invention provides an apparatus for RGB color space gamut conversion, including the following modules:

a source data registration module, for inputting RGB-based source graphic data;

a division module, for dividing the RGB color space having all the colors corresponding to source graphic data into m*n*k source cubes, where 0<m, n, k<256;

a definition module, for defining eight vertices of each source cube as a, b, c, d, e, f, g, and h, where a=(aR, aG, aB), b=(bR, bG, bB), . . . , h=(hR, hG, hB), and defining eight vertices of the target cube converted from source cube through gamut conversion as a', b', c', d', e', f', g', and h', where a'=(aR', aG', aB'), b=(bR', bG', bB'), . . . , h=(hR', hG', hB');

a first projection module, for projecting any point o in the RGB color space having all the colors corresponding to source graphic data onto point N on the plane formed by four vertices e, f, g and h of source cube, with the projected point N corresponding to the four coordination points i, j, k and l on the four sides of the plane formed by four vertices e, f, g and h of source cube, where i=(iR, iG, iB), j=(jR, jG, jB), k=(kR, kG, kB), l=(lR, lG, lB); projecting any point o in the RGB color space having all the colors corresponding to source graphic data onto point M on the plane formed by four vertices a, b, c and d of source cube, with the projected point M corresponding to the four coordination points p, q, r and s on the four sides of the plane formed by four vertices a, b, c and d of source cube, where p=(pR, pG, pB), q=(qR, qG, qB), r=(rR, rG, rB), s=(sR, sG, sB);

a second projecting module, for defining the point in the target cube corresponding to point o in the RGB color space having all the colors corresponding to source graphic data as point o' and projecting point o' in the target cube onto point N' on the plane formed by four vertices e', f', g' and h' of target cube, with the projected point N' corresponding to the four coordination points i', j', k' and l' on the four sides of the plane formed by four vertices e', f', g' and h' of target cube, where l'=(iR', iG', iB'), j'=(jR', jG', jB'), k'=(kR', kG', kB'), l'=(lR', lG', lB'); projecting point o' in the target cube onto point M' on the plane formed by four vertices a', b', c' and d' of target cube, with the projected point M' corresponding to the four coordination points p', q', r' and s' on the four sides of the plane formed by four vertices a', b', c' and d' of target cube, where p'=(pR', pG', pB'), q'=(qR', qG', qB'), r'=(rR', rG', rB'), s'=(sR', sG', sB');

a first computation module, for performing the following computations: based on four coordination points i, j, k and l on the four sides of the plane formed by four vertices e, f, g and h of source cube, computing four coordination points i', j', k' and l' on the four sides of the plane formed by four vertices e', f', g' and h' of target cube; based on four coordination points p, q, r and s on the four sides of the plane formed by four vertices a, b, c and d of source cube, computing four coordination points p', q', r' and s' on the four sides of the plane formed by four vertices a', b', c' and d' of target cube;

a second computation module, for performing the following computations: based on the computed four coordination points i', j', k' and l' on the four sides of the plane formed by four vertices e', f', g' and h' of target cube, computing point N' projected by point o' on the plane formed by four vertices e', f', g' and h' of target cube; based on the computed four coordination points p', q', r' and s' on the four sides of the plane formed by four vertices a', b', c' and d' of target cube, computing point M' projected by point o' on the plane formed by four vertices a', b', c' and d' of target cube;

a third computation module, for performing the following computation: based on the computed point N' on the plane formed by four vertices e', f', g' and h' of target cube and the computed point M' on the plane formed by four vertices a', b', c' and d' of target cube, computing the data of point o' in the target cube corresponding to point o in the RGB color space having all the colors corresponding to source graphic data; and a target data outputting module, for outputting or preserving the data of point o' in the target cube corresponding to point o in the RGB color space having all the colors corresponding to source graphic data, and the data of all points o's in the target cube forming the target color after the color gamut conversion.

Yet another exemplary embodiment of the present invention provides a liquid crystal display device, including the following modules:

a source data registration module, for inputting RGB-based source graphic data;

a division module, for dividing the RGB color space having all the colors corresponding to source graphic data into m*n*k source cubes, where 0<m, n, k<256;

a definition module, for defining eight vertices of each source cube as a, b, c, d, e, f, g, and h, where a=(aR, aG, aB), b=(bR, bG, bB), . . . , h=(hR, hG, hB), and defining eight vertices of the target cube converted from source cube through gamut conversion as a', b', c', d', e', f', g', and h', where a'=(aR', aG', aB'), b=(bR', bG', bB'), . . . , h=(hR', hG', hB');

a first projection module, for projecting any point o in the RGB color space having all the colors corresponding to source graphic data onto point N on the plane formed by four vertices e, f, g and h of source cube, with the projected point N corresponding to the four coordination points i, j, k and l on the four sides of the plane formed by four vertices e, f, g and h of source cube, where i=(iR, iG, iB), j=(jR, jG, jB), k=(kR, kG, kB), l=(lR, lG, lB); projecting any point o in the RGB color space having all the colors corresponding to source graphic data onto point M on the plane formed by four vertices a, b, c and d of source cube, with the projected point M corresponding to the four coordination points p, q, r and s on the four sides of the plane formed by four vertices a, b, c and d of source cube, where p=(pR, pG, pB), q=(qR, qG, qB), r=(rR, rG, rB), s=(sR, sG, sB);

a second projecting module, for defining the point in the target cube corresponding to point o in the RGB color space having all the colors corresponding to source graphic data as point o' and projecting point o' in the target cube onto point N' on the plane formed by four vertices e', f', g' and h' of target cube, with the projected point N' corresponding to the four coordination points i', j', k' and l' on the four sides of the plane formed by four vertices e', f', g' and h' of target cube, where l'=(iR', iG', iB'), j'=(jR', jG', jB'), k'=(kR', kG', kB'), l'=(lR', lG', lB'); projecting point o' in the target cube onto point M' on the plane formed by four vertices a', b', c' and d' of target cube, with the projected point M' corresponding to the four coordination points p', q', r' and s' on the four sides of the plane formed by four vertices a', b', c' and d' of target cube, where p'=(pR', pG', pB'), q'=(qR', qG', qB'), r'=(rR', rG', rB'), s'=(sR', sG', sB');

a first computation module, for performing the following computations: based on four coordination points i, j, k and l on the four sides of the plane formed by four vertices e, f, g and h of source cube, computing four coordination points i', j', k' and l' on the four sides of the plane formed by four vertices e', f', g' and h' of target cube; based on four coordination points p, q, r and s on the four sides of the plane formed by four vertices a, b, c and d of source cube, computing four coordination points p', q', r' and s' on the four sides of the plane formed by four vertices a', b', c' and d' of target cube;

a second computation module, for performing the following computations: based on the computed four coordination points i', j', k' and l' on the four sides of the plane formed by four vertices e', f', g' and h' of target cube, computing point N' projected by point o' on the plane formed by four vertices e', f', g' and h' of target cube; based on the computed four coordination points p', q', r' and s' on the four sides of the plane formed by four vertices a', b', c' and d' of target cube, computing point M' projected by point o' on the plane formed by four vertices a', b', c' and d' of target cube;

a third computation module, for performing the following computation: based on the computed point N' on the plane formed by four vertices e', f', g' and h' of target cube and the computed point M' on the plane formed by four vertices a', b', c' and d' of target cube, computing the data of point o' in the target cube corresponding to point o in the RGB color space having all the colors corresponding to source graphic data;

a target data outputting module, for outputting or preserving the data of point o' in the target cube corresponding to point o in the RGB color space having all the colors corresponding to source graphic data, and the data of all points o's in the target cube forming the target color after the color gamut conversion; and a display module, for displaying the target graphic data according to the target color after the described color gamut conversion.

The efficacy of the present invention is to be distinguished from the state of the art in the color gamut conversion and liquid crystal display device technologies. The present invention divides the color space of the source graphic data into m*n*k source cubes; projects any point o in the color space having the source graphic data onto a point N on the upper plane of a source cube and onto a point M on the lower place of a source cube, and maps point N and point M to four coordination points on the four sides of the upper plane and the lower plane of source cube respectively; projects point o' in the target cube corresponding to point o onto a point N' on the upper plane of a target cube and onto a point M' on the lower place of a target cube, and maps point N' and point M' to four coordination points on the four sides of the upper plane and the lower plane of target cube respectively; based on the four coordination points on the four sides of the upper plane and the lower plane of source cube, computes the four coordination points on the four sides of the upper plane and the lower plane of target cube respectively; based on the computed four coordination points on the four sides of the upper plane and the lower plane of target cube, computes point N' projected by point o' on the upper plane of target cube and point M' projected by point o' on the lower plane of target cube; based on computed point N' on the upper plane of target cube and computed point M' on the lower plane of target cube, computes point o' in target cube corresponding to any point o in the color space having source graphic data; and then computes the target color after the color conversion from the color of any point in the source graphic data. Through this manner, it is possible to perform color conversion in the RGB color space, adjust the color performance of the output color in hue and color purity, and enhance or accentuate any specific colors.

BRIEF DESCRIPTION OF THE DRAWINGS

To make the technical solution of the embodiments according to the present invention, a brief description of the drawings that are necessary for the illustration of the embodiments will be given as follows. Apparently, the drawings described below show only example embodiments of the present invention and for those having ordinary skills in the art, other drawings may be easily obtained from these drawings without paying any creative effort. In the drawings.

DETAILED DESCRIPTION OF THE PREFERRED EMBODIMENTS

The following detailed description refers to the Figures and the embodiments of the present invention.

Figure 1:
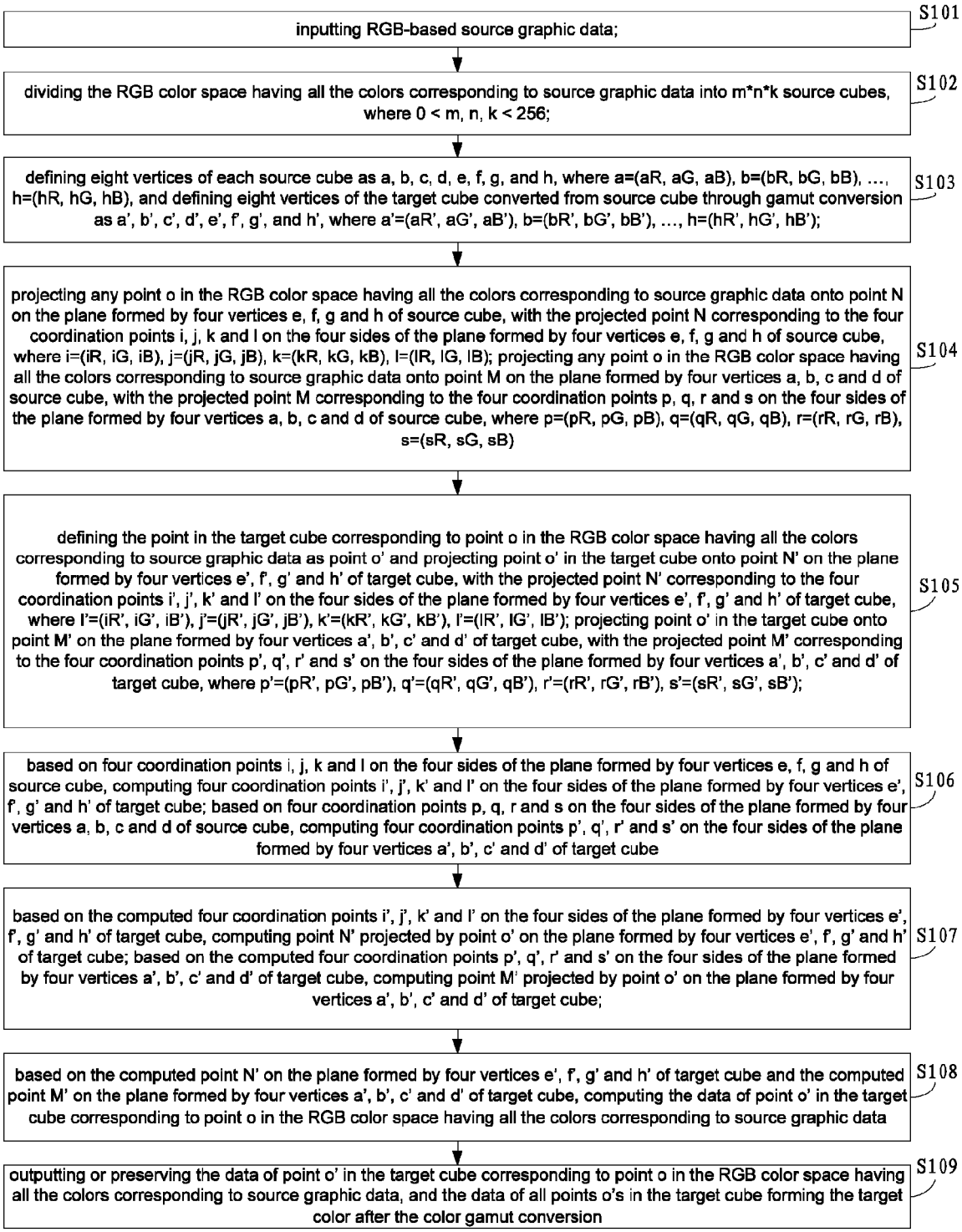
FIG. 1 is a schematic view showing the flowchart of an embodiment of RGB color space gamut conversion method according to the present invention.

FIG. 1 is a schematic view showing the flowchart of an embodiment of RGB color space gamut conversion method according to the present invention. As shown in FIG. 1, the method includes the following steps:

Step S101: inputting RGB-based source graphic data;

RGB color space uses the three basic colors in physics to represent colors. Any color can be obtained by mixing different amounts of red (R), green (G) and blue (B). The RGB space can also be described by a three-dimensional cube. The theory is to obtain all colors through the changes of red, green and blue color channels and the addition among the three color channels. The RGB represents the three color channels. This standard specification covers almost all the colors that human eyes can sense, and is one of the most widely used color systems. Each of the RGB factors of each pixel in the graph is allocated with a value ranging from 0 to 255. The RGB graph only uses three colors. With mixtures of different ratios, the monitor can display tens of millions of colors.

Step S102: dividing the RGB color space having all the colors corresponding to source graphic data into m*n*k source cubes, where $0<m, n, k<256$;

The RGB color space having all the colors corresponding to source graphic data has a large range. By dividing the RGB color space having all the colors corresponding to source graphic data, the large RGB color space having all the colors corresponding to source graphic data can be divided into smaller ranges. For example, the RGB color space having all the colors corresponding to source graphic data can be divided into 5*7*9, 50*70*90 or 100*140*180 source cubes. With m, n and k increasing, the division is finer and the range of each source cube is smaller.

Figure 2:
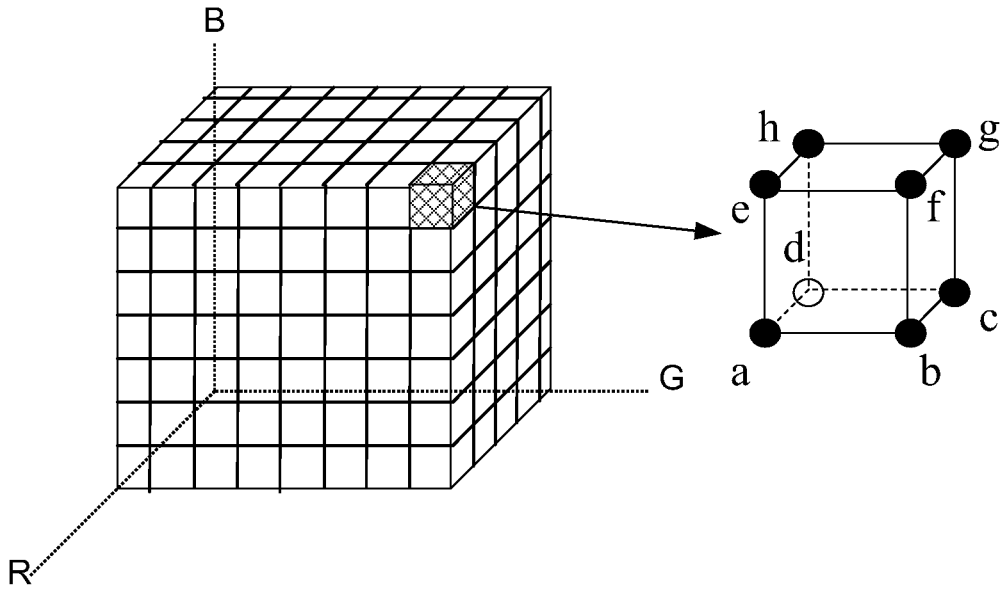
FIG. 2 is a schematic view showing an embodiment of RGB color space gamut conversion method dividing the RGB color space into a plurality of source cubes according to the present invention.
Figure 3:
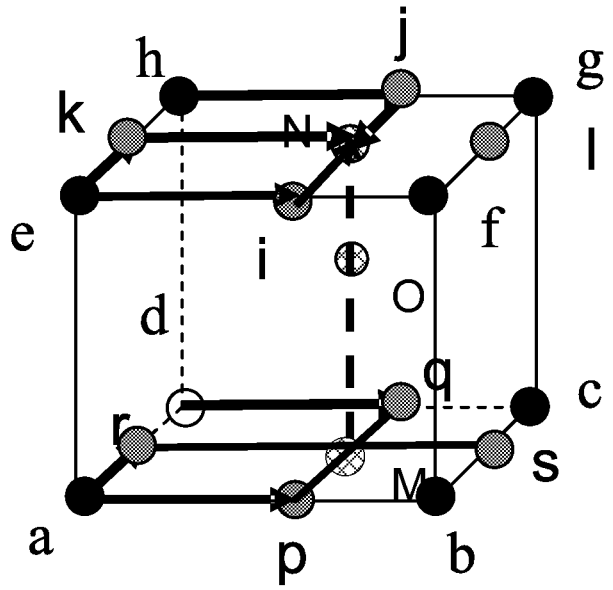
FIG. 3 is a schematic view showing a point in source cube and mapped coordination points in an embodiment of RGB color space gamut conversion method according to the present invention.
Figure 4:
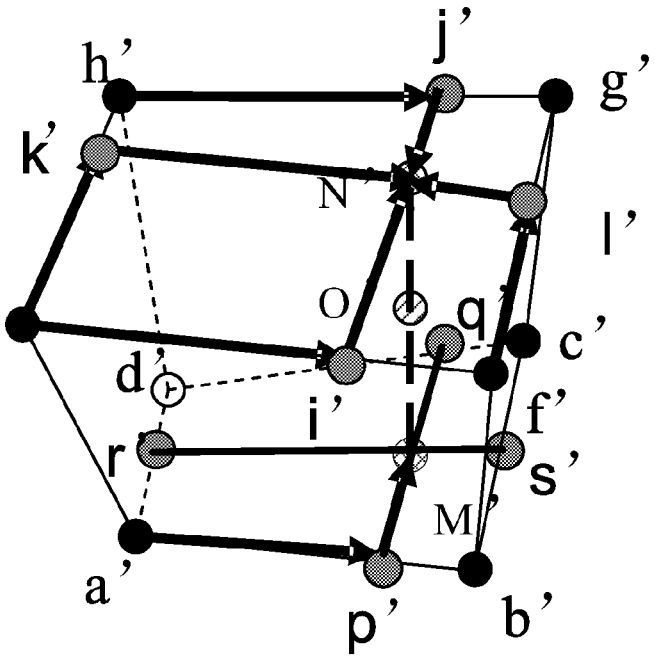
FIG. 4 is a schematic view showing a point projected by a point in source cube and mapped coordination points in an embodiment of RGB color space gamut conversion method according to the present invention.

Step S103: defining eight vertices of each source cube as a, b, c, d, e, f, g, and h, where $a=(a_R, a_G, a_B)$, $b=(b_R, b_G, b_B)$, . . . , $h=(h_R, h_G, h_B)$, and defining eight vertices of the target cube converted from source cube through gamut conversion as a', b', c', d', e', f', g', and h', where $a'=(a_R', a_c', a_B')$, $b=(b_R', b_G', b_B')$, . . . , $h=(h_R', h_G', h_B')$;

As shown in FIG. 2, the RGB color space 256*256*256 (8-bit grayscale representation of R, G and B=0, 1, . . . , 255) of source graphic data is divided into m*n*k source cubes (or m*m*m source right cubes). Each source cube has eight vertices, indicated as a, b, c, d, e, f, g, and h, as shown in FIG. 2 and FIG. 3. The colors in each source cube, according to the user's preference, are to be adjusted to the ultimate color performance. The corresponding target cube for new R', G' and B' color signals has eight vertices, indicated as a', b', c', d', e', f', g' and h'. At this point, the eight vertices of the target cube are the adjusted ultimate color performance, the data of vertices a', b', c', d', e', f', g', h' and R', G', B' are known data, as shown in FIG. 4. As seen in FIG. 3 and FIG. 4, the new corresponding target cube is no longer a right cube, but has different angles and sizes in different directions.

Step S104: projecting any point o in the RGB color space having all the colors corresponding to source graphic data onto point N on the plane formed by four vertices e, f, g and h of source cube, with the projected point N corresponding to the four coordination points i, j, k and l on the four sides of the plane formed by four vertices e, f, g and h of source cube, where $i=(i_R, i_c, i_B)$, $j=(j_R, j_G, j_B)$, $k=(k_R, k_G, k_B)$, $l=(l_R, l_G, l_B)$; projecting any point o in the RGB color space having all the colors corresponding to source graphic data onto point M on the plane formed by four vertices a, b, c and d of source cube, with the projected point M corresponding to the four coordination points p, q, r and s on the four sides of the plane formed by four vertices a, b, c and d of source cube, where $p=(p_R, p_G, p_B)$, $q=(q_R, q_G, q_B)$, $r=(r_R, r_G, r_B)$, $s=(s_R, s_G, s_B)$;

Step S105: defining the point in the target cube corresponding to point o in the RGB color space having all the colors corresponding to source graphic data as point o' and projecting point o' in the target cube onto point N' on the plane formed by four vertices e', f', g' and h' of target cube, with the projected point N' corresponding to the four coordination points i', j', k' and l' on the four sides of the plane formed by four vertices e', f', g' and h' of target cube, where $l'=(i_R', i_G', i_B')$, $j'=(j_R', j_G', j_B')$, $k'=(k_R', k_G', k_B')$, $l'=(l_R', l_G', l_B')$; projecting point o' in the target cube onto point M' on the plane formed by four vertices a', b', c' and d' of target cube, with the projected point M' corresponding to the four coordination points p', q', r' and s' on the four sides of the plane formed by four vertices a', b', c' and d' of target cube, where $p'=(p_R', p_G', p_B')$, $q'=(q_R', q_G', q_B')$, $r'=(r_R', r_G', r_B')$, $s'=(s_R', s_G', s_B')$;

Step S104 and step S105 can be executed in no particular order. In other words, Step S104 can be executed either before or after step S105.

As shown in FIG. 3 and FIG. 4, point N projected by any point o in the RGB color space having all the colors corresponding to source graphic data onto the plane formed by four vertices e, f, g and h of source cube is mapped to four coordination points l, j, k and l on the same plane; point N' projected by point o' in target cube corresponding to point o onto the plane formed by four vertices e', f', g' and h' of target cube is mapped to four coordination points l', j', k' and l' on the same plane formed; point M projected by any point o in the RGB color space having all the colors corresponding to source graphic data onto the plane formed by four vertices a, b, c and d of source cube is mapped to four coordination points p, q, r and s on the same plane; point M' projected by point o' in target cube corresponding to point o onto the plane formed by four vertices a', b', c' and d' of target cube is mapped to four coordination points p', q', r' and s' on the same plane formed; where eight mapped coordination points l', j', k', l', p', q', r' and s' of target cube are unknown data.

Step S106: based on four coordination points i, j, k and l on the four sides of the plane formed by four vertices e, f, g and h of source cube, computing four coordination points i', j', k' and l' on the four sides of the plane formed by four vertices e', f', g' and h' of target cube; based on four coordination points p, q, r and s on the four sides of the plane formed by four vertices a, b, c and d of source cube, computing four coordination points p', q', r' and s' on the four sides of the plane formed by four vertices a', b', c' and d' of target cube;

As shown in FIG. 3 and FIG. 4, four mapped coordination points i', j', k' and l' of target cube can be computed based on four coordination points i, j, k and l of source cube; similarly, four mapped coordination points p', q', r' and s' of target cube can be computed based on four coordination points p, q, r and s of source cube.

Step S107: based on the computed four coordination points i', j', k' and l' on the four sides of the plane formed by four vertices e', f', g' and h' of target cube, computing point N' projected by point o' on the plane formed by four vertices e', f', g' and h' of target cube; based on the computed four coordination points p', q', r' and s' on the four sides of the plane formed by four vertices a', b', c' and d' of target cube, computing point M' projected by point o' on the plane formed by four vertices a', b', c' and d' of target cube;

As shown in FIG. 3 and FIG. 4, point N' of target cube can be computed based on four mapped coordination points l', j', k' and l' of target cube; similarly, point M' of target cube can be computed based on four mapped coordination points p', q', r' and s' of source cube. Because point N' is at the intersection of the line connecting l' and j' and the line connecting k' and l', and point M' is at the intersection of the line connecting p' and q' and the line connecting r' and s', hence point N' and point M' can be computed.

Step S108: based on the computed point N' on the plane formed by four vertices e', f', g' and h' of target cube and the computed point M' on the plane formed by four vertices a', b', c' and d' of target cube, computing the data of point o' in the target cube corresponding to point o in the RGB color space having all the colors corresponding to source graphic data;

Based on the two projected points N' and M' by point o' in the target cube corresponding to point o in the RGB color space having all the colors corresponding to source graphic data, this step is to compute the data of point o' in the target cube corresponding to point o in the RGB color space having the source graphic data.

Step S109: outputting or preserving the data of point o' in the target cube corresponding to point o in the RGB color space having all the colors corresponding to source graphic data, and the data of all points o's in the target cube forming the target color after the color gamut conversion.

Figure 5:
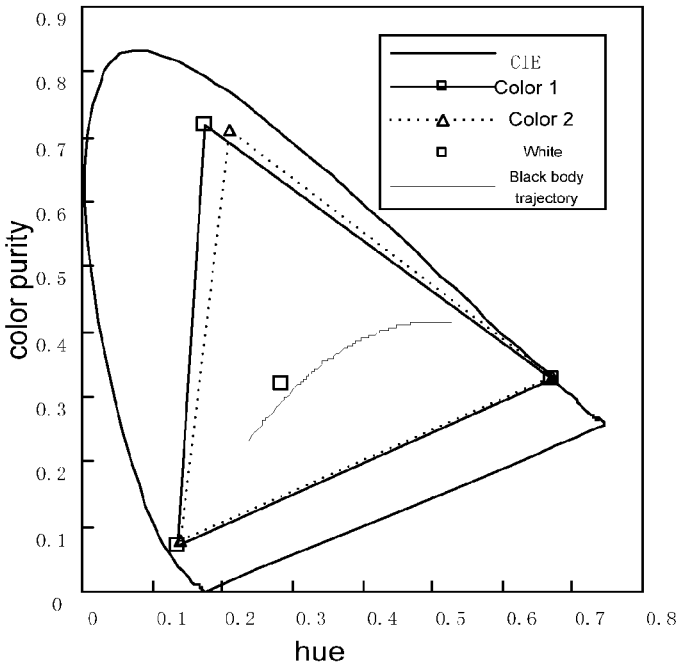
FIG. 5 is a schematic view showing a plot of two-dimensional hue and color purity in CIE 1931 color space.

FIG. 5 is a schematic view showing a plot of two-dimensional hue and color purity in CIE 1931 color space. As shown in FIG. 5, the RGB input signal of source graph has the color performance, such as chroma contents of "color 1", in CIE 1931 color space. After converting the R, G, B signals and based on the color preference, the source color can be converted from "color 1" into "color 2" to make the source green color appearing yellowish. Through the signal conversion, the hue of greenish color displayed on the monitor can be converted to the yellowish color to soften the overall image.

The aforementioned step of computing four coordination points i', j', k' and l' on the four sides of the plane formed by four vertices e', f', g' and h' of target cube based on four coordination points i, j, k and l on the four sides of the plane formed by four vertices e, f, g and h of source cube, and computing four coordination points p', q', r' and s' on the four sides of the plane formed by four vertices a', b', c' and d' of target cube based on four coordination points p, q, r and s on the four sides of the plane formed by four vertices a, b, c and d of source cube further including the following steps:

defining the basic unit of R, G, B of each source cube as $X_R$, $X_G$, and $X_B$, where $$X_R=b_R-a_R=c_R-d_R=f_R-e_R=g_R-h_R$$

$$X_G=d_G-a_G=c_G-b_G=h_G-e_G=g_G-f_G$$

$$X_B=e_B-a_B=h_B-d_B=g_B-c_B=f_B-b_B$$

based on a first-type equation, a second-type equation, a third-type equation and a fourth-type equation between four coordination points i, j, k and l on the four sides of the plane formed by four vertices e, f, g and h of source cube and four coordination points i', j', k' and l' on the four sides of the plane formed by four vertices e', f', g' and h' of target cube, computing four coordination points i', j', k' and l' on the four sides of the plane formed by four vertices e', f', g' and h' of target cube, where the first-type, second-type, third-type and fourth-type quations expressed as following respectively:

$$i'=(i_R', i_G', i_B')\ k'=(k_R',k_G',k_B')$$

$$l_R'=e_R'+(i_R-e_R)/X_R^*(f_R'-e_R')\ k_R'=e_R'+(k_R-e_R)/X_R^*(h_R'-e_R')$$

$$l_G'=e_G'+(i_G-e_G)/X_G^*(f_G'-e_G')\ k_G'=e_G'+(k_G-e_G)/X_G^*(h_G'-e_G')$$

$l_B'=e_B'+(i_B-e_B)/X_B*(f_B'-e_B')$ $k_B'=e_B'+(k_B-e_B)/X_B*(h_B'-e_B')$ $j'=(j_R', j_G', j_B')$ $l'=(l_R', l_G', l_B')$ $j_R'=h_R'+(j_R-h_R)/X_R*(g_R'-h_R')$ $l_R'=f_R'+(l_R-f_R)/X_R*(g_R'-f_R')$ $j_G'=h_G'+(j_G-h_G)/X_G*(g_G'-h_G')$ $l_G'=f_G'+(l_G-f_G)/X_G*(g_G'-f_G')$ $j_B'=h_B'+(j_B-h_B)/X_B*(g_B'-h_B')$ $l_B'=f_B'+(l_B-f_B)/X_B*(g_B'-f_B')$ based on a fifth-type equation, a sixth-type equation, a seventh-type equation and a eighth-type equation between four coordination points p, q, r and s on the four sides of the plane formed by four vertices a, b, c and d of source cube and four coordination points p', q', r' and s' on the four sides of the plane formed by four vertices a', b', c' and d' of target cube, computing four coordination points p', q', r' and s' on the four sides of the plane formed by four vertices a', b', c' and d' of target cube, where the fifth-type, sixth-type, seventh-type and eighth-type equations expressed as following respectively:

$p'=(p_R', p_G', p_B')$ $r'=(r_R', r_G', r_B')$ $p_R'=a_R'+(p_R-ae_R)/X_R*(b_R'-a_R')$ $r_R'=a_R'+(r_R-a_R)/X_R*(d_R'-a_R')$ $p_G'=a_G'+(p_G-a_G)/X_G*(b_G'-a_G')$ $r_G'=a_G'+(r_G-a_G)/X_G*(d_G'-a_G')$ $p_B'=a_B'+(p_B-a_B)/X_B*(b_B'-a_B')$ $r_B'=a_B'+(r_B-a_B)/X_B*(d_B'-a_B')$ $q'=(q_R', q_G', q_B')$ $s'=(s_R', s_G', s_B')$ $q_R'=d_R'+(q_R-d_R)/X_R*(c_R'-d_R')$ $s_R'=b_R'+(s_R-b_R)/X_R*(c_R'-b_R')$ $q_G'=d_G'+(q_G-d_G)/X_G*(c_G'-d_G')$ $s_G'=b_G'+(s_G-b_G)/X_G*(c_G'-b_G')$ $q_B'=d_B'(q_B-d_B)/X_B*(c_B'-d_B')$ $s_B'b_B'+(s_B-b_B)/X_B*(c_B'-b_B')$

Based on the aforementioned first-type, second-type, third-type and fourth-type equations, four mapped coordination points l', j', k', and l' in target cube can be computed; similarly, based on fifth-type, sixth-type, seventh-type and eighth-type equations, four mapped coordination points p', q', r' and s' can be computed. In actual application, four coordination points i, j, k and l on the four sides of the plane formed by four vertices e, f, g and h of source cube and four coordination points i', j', k' and l' on the four sides of the plane formed by four vertices e', f', g' and h' of target cube can satisfy other equations; similarly, four coordination points p, q, r and s on the four sides of the plane formed by four vertices a, b, c and d of source cube and four coordination points p', q', r' and s' on the four sides of the plane formed by four vertices a', b', c' and d' of target cube can satisfy other equations.

The aforementioned the step of computing the data of point o' in the target cube corresponding to point o in the RGB color space having all the colors corresponding to source graphic data, based on the computed point N' on the plane formed by four vertices e', f', g' and h' of target cube and the computed point M' on the plane formed by four vertices a', b', c' and d' of target cube further includes the steps:

defining $\overline{NO}$ as the distance between point N on the plane formed by four vertices e, f, g, and h of source cube and any point o in the source cube, $\overline{MO}$ as the distance between point M on the plane formed by four vertices a, b, c, and d of source cube and any point o in the source cube, $\overline{N'O'}$ as the distance between point N' on the plane formed by four vertices e', f', g', and h' of target cube and point o' in the target cube corresponding to any point o, and $\overline{M'O'}$ as the distance between point M' on the plane formed by four vertices a', b', c', and d' of target cube and point o' in the target cube corresponding to any point o;

based on a ninth-type equation among point N' on the plane formed by four vertices e', f', g', and h' of target cube, point M' on the plane formed by four vertices a', b', c', and d' of target cube and point o' in the target cube corresponding to any point o, computing the data of point o' in the target cube corresponding to point o in the RGB color space having all the colors corresponding to source graphic data, wherein the ninth-type equation is:

$$O_R' = N_R' + (N_R' - M_R')^* \frac{\overline{NO}}{\overline{NO} + \overline{MO}}$$

$$O_G' = N_G' + (N_G' - M_G')^* \frac{\overline{NO}}{\overline{NO} + \overline{MO}}$$

$$\frac{\overline{MO}}{\overline{NO}} = \frac{\overline{M'O'}}{\overline{N'O'}} \quad O_B' = N_B' + (N_B' - M_B')^* \frac{\overline{NO}}{\overline{NO} + \overline{MO}}$$

Based on the ninth-type equation, the data of point o' in the target cube corresponding to point o in the RGB color space having all the colors corresponding to source graphic data can be computed. In actual application, point N' on the plane formed by four vertices e', f', g', and h' of target cube, point M' on the plane formed by four vertices a', b', c', and d' of target cube and point o' in the target cube corresponding to any point o can satisfy other equations.

wherein m*n*k source cubes are the m*n*k source right cubes, with m, n and k all having equal values.

The present invention is to be distinguished from the state of the art in the color gamut conversion and liquid crystal display device technologies. The present invention divides the color space of the source graphic data into m*n*k source cubes; projects any point o in the color space having the source graphic data onto a point N on the upper plane of a source cube and onto a point M on the lower place of a source cube, and maps point N and point M to four coordination points on the four sides of the upper plane and the lower plane of source cube respectively; projects point o' in the target cube corresponding to point o onto a point N' on the upper plane of a target cube and onto a point M' on the lower place of a target cube, and maps point N' and point M' to four coordination points on the four sides of the upper plane and the lower plane of target cube respectively; based on the four coordination points on the four sides of the upper plane and the lower plane of source cube, computes the four coordination points on the four sides of the upper plane and the lower plane of target cube respectively; based on the computed four coordination points on the four sides of the upper plane and the lower plane of target cube, computes point N' projected by point o' on the upper plane of target cube and point M' projected by point o' on the lower plane of target cube; based on computed point N' on the upper plane of target cube and computed point M' on the lower plane of target cube, computes point o' in target cube corresponding to any point o in the color space having source graphic data; and then computes the target color after the color conversion from the color of any point in the source graphic data. Through this manner, it is possible to perform color conversion in the RGB color space, adjust the color performance of the output color in hue and color purity, and enhance or accentuate any specific colors.

Figure 6:
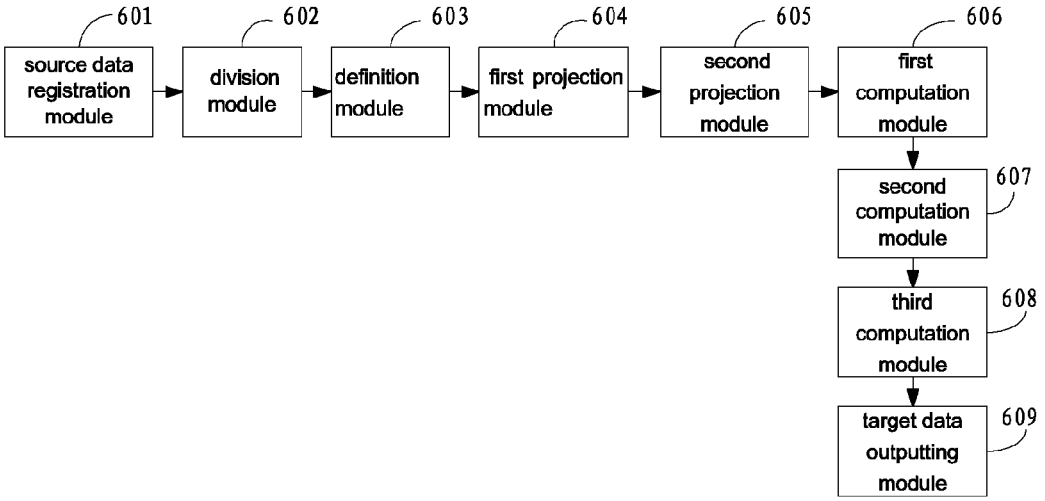
FIG. 6 is a schematic view showing an embodiment of RGB color space gamut conversion apparatus according to the present invention.

FIG. 6 is a schematic view showing an embodiment of RGB color space gamut conversion apparatus according to the present invention. As shown in FIG. 6, the apparatus includes a source data registration module 601, a division module 602, a definition module 603, a first projection module 604, a second projection module 605, a first computation module 606, a second computation module 607, a third computation module 608 and a target data outputting module 609.

Source data registration module 601 is for inputting RGB-based source graphic data.

RGB color space uses the three basic colors in physics to represent colors. Any color can be obtained by mixing different amounts of red (R), green (G) and blue (B). The RGB space can also be described by a three-dimensional cube. The theory is to obtain all colors through the changes of red, green and blue color channels and the addition among the three color channels. The RGB represents the three color channels. This standard specification covers almost all the colors that human eyes can sense, and is one of the most widely used color systems.

Division module 602 is for dividing the RGB color space having all the colors corresponding to source graphic data into m*n*k source cubes, where 0<m, n, k<256.

The RGB color space having all the colors corresponding to source graphic data has a large range. By dividing the RGB color space having all the colors corresponding to source graphic data, the large RGB color space having all the colors corresponding to source graphic data can be divided into smaller ranges. For example, the RGB color space having all the colors corresponding to source graphic data can be divided into 5*7*9, 50*70*90 or 100*140*180 source cubes. With m, n and k increasing, the division is finer and the range of each source cube is smaller.

Definition module 603 is for defining eight vertices of each source cube as a, b, c, d, e, f, g, and h, where a=(aR, aG, aB), b=(bR, bG, bB), . . . , h=(hR, hG, hB), and defining eight vertices of the target cube converted from source cube through gamut conversion as a', b', c', d', e', f', g', and h', where a'=(aR', aG', aB'), b=(bR', bG', bB'), . . . , h=(hR', hG', hB').

First projection module 604 is for projecting any point o in the RGB color space having all the colors corresponding to source graphic data onto point N on the plane formed by four vertices e, f, g and h of source cube, with the projected point N corresponding to the four coordination points i, j, k and l on the four sides of the plane formed by four vertices e, f, g and h of source cube, where i=(iR, iG, iB), j=(jR, jG, jB), k=(kR, kG, kB), l=(lR, lG, lB); projecting any point o in the RGB color space having all the colors corresponding to source graphic data onto point M on the plane formed by four vertices a, b, c and d of source cube, with the projected point M corresponding to the four coordination points p, q, r and s on the four sides of the plane formed by four vertices a, b, c and d of source cube, where p=(pR, pG, pB), q=(qR, qG, qB), r=(rR, rG, rB), s=(sR, sG, sB).

Second projection module 605 is for defining the point in the target cube corresponding to point o in the RGB color space having all the colors corresponding to source graphic data as point o' and projecting point o' in the target cube onto point N' on the plane formed by four vertices e', f', g' and h' of target cube, with the projected point N' corresponding to the four coordination points i', j', k' and l' on the four sides of the plane formed by four vertices e', f', g' and h' of target cube, where l'=(iR', iG', iB'), j'=(jR', jG', jB'), k'=(kR', kG', kB'), l'=(lR', lG', lB'); projecting point o' in the target cube onto point M' on the plane formed by four vertices a', b', c' and d' of target cube, with the projected point M' corresponding to the four coordination points p', q', r' and s' on the four sides of the plane formed by four vertices a', b', c' and d' of target cube, where p'=(pR', pG', pB'), q'=(qR', qG', qB'), r'=(rR', rG', rB'), s'=(sR', sG', sB')

First computation module 606 is for a first computation module, for performing the following computations: based on four coordination points i, j, k and l on the four sides of the plane formed by four vertices e, f, g and h of source cube, computing four coordination points i', j', k' and l' on the four sides of the plane formed by four vertices e', f', g' and h' of target cube; based on four coordination points p, q, r and s on the four sides of the plane formed by four vertices a, b, c and d of source cube, computing four coordination points p', q', r' and s' on the four sides of the plane formed by four vertices a', b', c' and d' of target cube.

Second computation module 607 is for performing the following computations: based on the computed four coordination points i', j', k' and l' on the four sides of the plane formed by four vertices e', f', g' and h' of target cube, computing point N' projected by point o' on the plane formed by four vertices e', f', g' and h' of target cube; based on the computed four coordination points p', q', r' and s' on the four sides of the plane formed by four vertices a', b', c' and d' of target cube, computing point M' projected by point o' on the plane formed by four vertices a', b', c' and d' of target cube.

Third computation module 608 is for performing the following computation: based on the computed point N' on the plane formed by four vertices e', f', g' and h' of target cube and the computed point M' on the plane formed by four vertices a', b', c' and d' of target cube, computing the data of point o' in the target cube corresponding to point o in the RGB color space having all the colors corresponding to source graphic data.

Target data outputting module 609 is for outputting or preserving the data of point o' in the target cube corresponding to point o in the color space having all the colors corresponding to source graphic data, and the data of all points o's in the target cube forming the target color after the color gamut conversion.

The present invention is to be distinguished from the state of the art in the color gamut conversion and liquid crystal display device technologies. The present invention divides the color space of the source graphic data into m*n*k source cubes; projects any point o in the color space having the source graphic data onto a point N on the upper plane of a source cube and onto a point M on the lower place of a source cube, and maps point N and point M to four coordination points on the four sides of the upper plane and the lower plane of source cube respectively; projects point o' in the target cube corresponding to point o onto a point N' on the upper plane of a target cube and onto a point M' on the lower place of a target cube, and maps point N' and point M' to four coordination points on the four sides of the upper plane and the lower plane of target cube respectively; based on the four coordination points on the four sides of the upper plane and the lower plane of source cube, computes the four coordination points on the four sides of the upper plane and the lower plane of target cube respectively; based on the computed four coordination points on the four sides of the upper plane and the lower plane of target cube, computes point N' projected by point o' on the upper plane of target cube and point M' projected by point o' on the lower plane of target cube; based on computed point N' on the upper plane of target cube and computed point M' on the lower plane of target cube, computes point o' in target cube corresponding to any point o in the color space having source graphic data; and then computes the target color after the color conversion from the color of any point in the source graphic data. Through this manner, it is possible to perform color conversion in the RGB color space, adjust the color performance of the output color in hue and color purity, and enhance or accentuate any specific colors.

Figure 7:
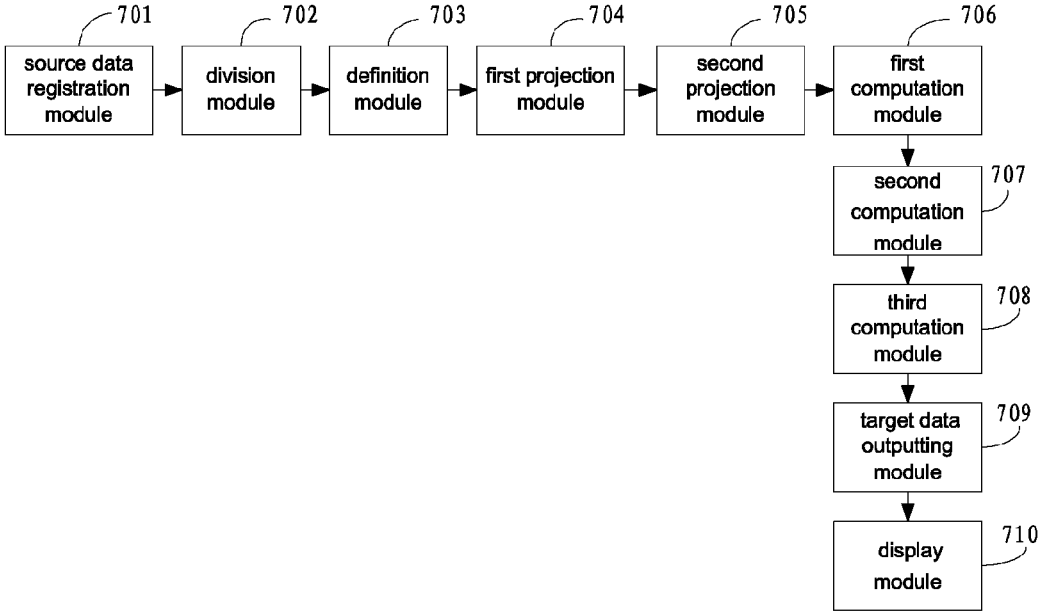
FIG. 7 is a schematic view showing an embodiment of liquid crystal display device according to the present invention.

FIG. 7 is a schematic view showing an embodiment of liquid crystal display device according to the present invention. As shown in FIG. 7, the liquid crystal display device includes a source data registration module 701, a division module 702, a definition module 703, a first projection module 704, a second projection module 705, a first computation module 706, a second computation module 707, a third computation module 708, a target data outputting module 709 and a display module 710.

Source data registration module 701 is for inputting RGB-based source graphic data.

Division module 702 is for dividing the RGB color space having all the colors corresponding to source graphic data into m*n*k source cubes, where 0<m, n, k<256.

Definition module 703 is for defining eight vertices of each source cube as a, b, c, d, e, f, g, and h, where a=(aR, aG, aB), b=(bR, bG, bB), . . . , h=(hR, hG, hB), and defining eight vertices of the target cube converted from source cube through gamut conversion as a', b', c', d', e', f', g', and h', where a'=(aR', aG', aB'), b=(bR', bG', bB'), . . . , h=(hR', hG', hB').

First projection module 704 is for projecting any point o in the RGB color space having all the colors corresponding to source graphic data onto point N on the plane formed by four vertices e, f, g and h of source cube, with the projected point N corresponding to the four coordination points i, j, k and l on the four sides of the plane formed by four vertices e, f, g and h of source cube, where i=(iR, iG, iB), j=(jR, jG, jB), k=(kR, kG, kB), l=(lR, lG, lB); projecting any point o in the RGB color space having all the colors corresponding to source graphic data onto point M on the plane formed by four vertices a, b, c and d of source cube, with the projected point M corresponding to the four coordination points p, q, r and s on the four sides of the plane formed by four vertices a, b, c and d of source cube, where p=(pR, pG, pB), q=(qR, qG, qB), r=(rR, rG, rB), s=(sR, sG, sB).

Second projection module 705 is for defining the point in the target cube corresponding to point o in the RGB color space having all the colors corresponding to source graphic data as point o' and projecting point o' in the target cube onto point N' on the plane formed by four vertices e', f', g' and h' of target cube, with the projected point N' corresponding to the four coordination points i', j', k' and l' on the four sides of the plane formed by four vertices e', f', g' and h' of target cube, where l'=(iR', iG', iB'), j'=(jR', jG', jB'), k'=(kR', kG', kB'), l'=(lR', lG', lB'); projecting point o' in the target cube onto point M' on the plane formed by four vertices a', b', c' and d' of target cube, with the projected point M' corresponding to the four coordination points p', q', r' and s' on the four sides of the plane formed by four vertices a', b', c' and d' of target cube, where p'=(pR', pG', pB'), q'=(qR', qG', qB'), r'=(rR', rG', rB'), s'=(sR', sG', sB')

First computation module 706 is for a first computation module, for performing the following computations: based on four coordination points i, j, k and l on the four sides of the plane formed by four vertices e, f, g and h of source cube, computing four coordination points i', j', k' and l' on the four sides of the plane formed by four vertices e', f', g' and h' of target cube; based on four coordination points p, q, r and s on the four sides of the plane formed by four vertices a, b, c and d of source cube, computing four coordination points p', q', r' and s' on the four sides of the plane formed by four vertices a', b', c' and d' of target cube.

Second computation module 707 is for performing the following computations: based on the computed four coordination points i', j', k' and l' on the four sides of the plane formed by four vertices e', f', g' and h' of target cube, computing point N' projected by point o' on the plane formed by four vertices e', f', g' and h' of target cube; based on the computed four coordination points p', q', r' and s' on the four sides of the plane formed by four vertices a', b', c' and d' of target cube, computing point M' projected by point o' on the plane formed by four vertices a', b', c' and d' of target cube.

Third computation module 708 is for performing the following computation: based on the computed point N' on the plane formed by four vertices e', f', g' and h' of target cube and the computed point M' on the plane formed by four vertices a', b', c' and d' of target cube, computing the data of point o' in the target cube corresponding to point o in the RGB color space having all the colors corresponding to source graphic data.

Target data outputting module 709 is for outputting or preserving the data of point o' in the target cube corresponding to point o in the color space having all the colors corresponding to source graphic data, and the data of all points o's in the target cube forming the target color after the color gamut conversion.

Display module 710 is for displaying the target graphic data according to the target color after the described color gamut conversion.

The present invention is to be distinguished from the state of the art in the color gamut conversion and liquid crystal display device technologies. The present invention divides the color space of the source graphic data into m*n*k source cubes; projects any point o in the color space having the source graphic data onto a point N on the upper plane of a source cube and onto a point M on the lower place of a source cube, and maps point N and point M to four coordination points on the four sides of the upper plane and the lower plane of source cube respectively; projects point o' in the target cube corresponding to point o onto a point N' on the upper plane of a target cube and onto a point M' on the lower place of a target cube, and maps point N' and point M' to four coordination points on the four sides of the upper plane and the lower plane of target cube respectively; based on the four coordination points on the four sides of the upper plane and the lower plane of source cube, computes the four coordination points on the four sides of the upper plane and the lower plane of target cube respectively; based on the computed four coordination points on the four sides of the upper plane and the lower plane of target cube, computes point N' projected by point o' on the upper plane of target cube and point M' projected by point o' on the lower plane of target cube; based on computed point N' on the upper plane of target cube and computed point M' on the lower plane of target cube, computes point o' in target cube corresponding to any point o in the color space having source graphic data; and then computes the target color after the color conversion from the color of any point in the source graphic data. Through this manner, it is possible to perform color conversion in the RGB color space, adjust the color performance of the output color in hue and color purity, and enhance or accentuate any specific colors.

Embodiments of the present invention have been described, but not intending to impose any unduly constraint to the appended claims. Any modification of equivalent structure or equivalent process made according to the disclosure and drawings of the present invention, or any application thereof, directly or indirectly, to other related fields of technique, is considered encompassed in the scope of protection defined by the clams of the present invention.

What is claimed is:

1. A color gamut conversion method based on RGB color space, comprising the steps of:

inputting RGB-based source graphic data;

dividing RGB color space having all colors corresponding to said source graphic data into m*n*k source cubes, where 0<m, n, k<256;

defining eight vertices of each said source cube as a, b, c, d, e, f, g, and h, where $a=(a_R, a_G, a_B)$, $b=(b_R, b_G, b_B)$, . . . , $h=(h_R, h_G, h_B)$, and defining eight vertices of target cube converted from said source cube through gamut conversion as a', b', c', d', e', f', g', and h', where $a'=(a_R', a_G', a_B')$, $b=(b_R', b_G', b_B')$, . . . , $h=(h_R', h_G', h_B')$;

projecting any point o in said RGB color space having all colors corresponding to said source graphic data onto point N on a plane formed by four vertices e, f, g and h of source cube, with said projected point N corresponding to four coordination points i, j, k and l on four sides of said plane formed by four vertices e, f, g and h of source cube, where $i=(i_R, i_G, i_B)$, $j=(j_R, j_G, j_{B)}$, $k=(kR', k_G, k_B)$, $l=(l_R, l_G, l_B)$; projecting any point o in said RGB color space having all colors corresponding to said source graphic data onto point M on a plane formed by four vertices a, b, c and d of source cube, with said projected point M corresponding to four coordination points p, q, r and s on four sides of said plane formed by four vertices a, b, c and d of source cube, where $p=(p_R, p_G, p_B)$, $q=(q_R, q_G, q_B)$, $r=(r_R, r_G, r_B)$, $s=(s_R, s_G, s_B)$;

defining a point in said target cube corresponding to said point o in said RGB color space having all colors corresponding to said source graphic data as point o' and projecting point o' in said target cube onto point N' on a plane formed by four vertices e', f', g' and h' of target cube, with said projected point N' corresponding to four coordination points i', j', k' and l' on four sides of said plane formed by four vertices e', f', g' and h' of target cube, where $i'=(i_R', i_G', i_B')$, $j'=(j_R', j_G', j_B')$, $k'=(k_R', k_G', k_B')$, $l'=(l_R', l_G', l_B')$; projecting point o' in said target cube onto point M' on a plane formed by four vertices a', b', c' and d' of target cube, with said projected point M' corresponding to four coordination points p', q', r' and s' on four sides of said plane formed by four vertices a', b', c' and d' of target cube, where $p'=(p_R', p_G', p_B')$, $q'=(q_R', q_G', q_B')$, $r'=(r_R', r_G', r_B')$, $s'=(s_R', s_G', s_B')$;

based on said four coordination points i, j, k and l on four sides of said plane formed by four vertices e, f, g and h of source cube, computing four coordination points i', j', k' and l' on four sides of said plane formed by four vertices e', f', g' and h' of target cube; based on said four coordination points p, q, r and s on four sides of said plane formed by four vertices a, b, c and d of source cube, computing four coordination points p', q', r' and s' on four sides of said plane formed by four vertices a', b', c' and d' of target cube;

based on computed said four coordination points i', j', k' and l' on four sides of said plane formed by four vertices e', f', g' and h' of target cube, computing point N' projected by point o' on said plane formed by four vertices e', f', g' and h' of target cube; based on computed said four coordination points p', q', r' and s' on four sides of said plane formed by four vertices a', b', c' and d' of target cube, computing point M' projected by point o' on said plane formed by four vertices a', b', c' and d' of target cube;

based on computed point N' on said plane formed by four vertices e', f', g' and h' of target cube and computed point M' on said plane formed by four vertices a', b', c' and d' of target cube, computing data of point o' in said target cube corresponding to said point o in said RGB color space having all colors corresponding to said source graphic data; and outputting or preserving said data of point o' in said target cube corresponding to point o in said color space having all colors corresponding to said source graphic data, and said data of all points o's in said target cube forming target color after color gamut conversion;

wherein said m*n*k source cubes are m*n*k right cubes with m, n and k all having equal values or m*n*k rectangular cuboids with two of m, n and k having equal values, said target cube correspondingly is not right cube or is not rectangular cuboid and has different angles and sizes in different directions.

2. The method as claimed in claim 1, wherein said step of based on said four coordination points i, j, k and l on four sides of said plane formed by four vertices e, f, g and h of source cube, computing four coordination points i', j', k' and l' on four sides of said plane formed by four vertices e', f', g' and h' of target cube; based on said four coordination points p, q, r and on four sides of said plane formed by four vertices a, b, c and d of source cube, computing four coordination points p', q', r' and s' on four sides of said plane formed by four vertices a', b', c' and d' of target cube further comprises the following steps:

defining basic unit of R, G, B of each source cube as $X_R$, $X_G$, and $X_B$, where $$X_R=b_R-a_R=c_R-d_R=f_R-e_R=g_R-h_R$$

$$X_G=d_G-a_G=c_G-b_G=h_G-e_G=g_G-f_G$$

$$X_B=e_B-a_B=h_B-d_B=g_B-c_B=f_B-b_B;$$

based on a first-type equation, a second-type equation, a third-type equation and a fourth-type equation between said four coordination points i, j, k and l on four sides of said plane formed by four vertices e, f, g and h of source cube and said four coordination points i', j', k' and l' on four sides of said plane formed by four vertices e', f', g' and h' of target cube, computing four coordination points i', j', k' and l' on four sides of said plane formed by four vertices e', f', g' and h' of target cube, wherein said first-type, second-type, third-type and fourth-type equations expressed as following respectively:

$$i'=(i_R', i_G', i_B')\ k'=(k_R',k_G',k_B')$$

$$i_R'=e_R'+(i_R-e_R)/X_R*(f_R'-e_R')\ k_R'=e_R'+(k_R-e_R)/X_R*(h_R'-e_R')$$

$$l_G'=e_G'+(i_G-e_G)/X_G*(f_G'-e_G')\ k_G'=e_G'+(k_G-e_G)/X_G*(h_G'-e_G')$$

$$l_B'=e_B'+(i_B-e_B)/X_B*(f_B'-e_B')\ k_B'=e_B'+(k_B-e_B)/X_B*(h_B'-e_B')$$

$$j'=(j_R', j_G', j_B')\ l'=(l_R', l_G', l_B')$$

$$j_R'=h_R'+(j_R-h_R)/X_R*(g_R'-h_R')\ l_R'=f_R'+(l_R-f_R)/X_R*(g_R'-f_R')$$

$$j_G'=h_G'+(j_G-h_G)/X_G*(g_G'-h_G')\ l_G'=f_G'+(l_G-f_G)/X_G*(g_G'-f_G')$$

$$j_B'=h_B'+(j_B-h_B)/X_B*(g_B'-h_B')\ l_B'=f_B'+(l_B-f_B)/X_B*(g_B'-f_B');\text{ and}$$

based on a fifth-type equation, a sixth-type equation, a seventh-type equation and a eighth-type equation between said four coordination points p, q, r and s on four sides of said plane formed by four vertices a, b, c and d of source cube and said four coordination points p', q', r' and s' on four sides of said plane formed by four vertices a', b', c' and d' of target cube, computing four coordination points p', q', r' and s' on four sides of said plane formed by four vertices a', b', c' and d' of target cube, wherein said fifth-type, sixth-type, seventh-type and eighth-type equations expressed as following respectively:

$$p'=(p_R', p_G', p_B')\ r'=(r_R', r_G', r_B')$$

$$p_R'=a_R'+(p_R-ae_R)/X_R*(b_R'-a_R')\ r_R'=a_R'+(r_R-a_R)/X_R*(d_R'-a_R')$$

$$p_G'=a_G'+(p_G-a_G)/X_G*(b_G'-a_G')\ r_G'=a_G'+(r_G-a_G)/X_G*(d_G'-a_G')$$

$$p_B'=a_B'+(p_B-a_B)/X_B*(b_B'-a_B')\ r_B'=a_B'+(r_B-a_B)/X_B*(d_B'-a_B')$$

$$q'=(q_R', q_G', q_B')\ s'=(s_R', s_G', s_B')$$

$$q_R'=d_R'+(q_R-d_R)/X_R*(c_R'-d_R')\ s_R'=b_R'+(s_R-b_R)/X_R*(c_R'-b_R')$$

$$q_G'=d_G'+(q_G-d_G)/X_G*(c_G'-d_G')\ s_G'=b_G'+(s_G-b_G)/X_G*(c_G'-b_G')$$

$$q_B'=d_B'(q_B-d_B)/X_B*(c_B'-d_B')\ s_B'b_B'+(s_B-b_B)/X_B*(c_B'-b_B').$$

3. The method as claimed in claim 1, wherein said step of based on computed point N' on said plane formed by four vertices e', f', g' and h' of target cube and computed point M' on said plane formed by four vertices a', b', c' and d' of target cube, computing data of point o' in said target cube corresponding to said point o in said RGB color space having all colors corresponding to said source graphic data further comprises the following steps:

defining $\overline{NO}$ as distance between point N on said plane formed by four vertices e, f, g, and h of source cube and any point o in said source cube, $\overline{MO}$ as distance between point M on said plane formed by four vertices a, b, c, and d of source cube and any point o in said source cube, $\overline{N'O'}$ as distance between point N' on said plane formed by four vertices e', f', g', and h' of target cube and point o' in said target cube corresponding to any point o, and $\overline{M'O'}$ as distance between point M' on said plane formed by four vertices a', b', c', and d' of target cube and point o' in said target cube corresponding to any point o; and based on ninth equations among point N' on said plane formed by four vertices e', f', g', and h' of target cube, point M' on said plane formed by four vertices a', b', c', and d' of target cube and point o' in said target cube corresponding to any point o, computing data of point o' in said target cube corresponding to point o in said RGB color space having all colors corresponding to said source graphic data, wherein said ninth equation are:

$$O'_R = N'_R + (N'_R - M'_R)^* \frac{\overline{NO}}{\overline{NO}+\overline{MO}}$$

$$O'_G = N'_G + (N'_G - M'_G)^* \frac{\overline{NO}}{\overline{NO}+\overline{MO}}$$

$$\frac{\overline{MO}}{\overline{NO}} = \frac{\overline{M'O'}}{\overline{N'O'}}\ O'_B = N'_B + (N'_B - M'_B)^* \frac{\overline{NO}}{\overline{NO}+\overline{MO}}.$$

* * * * *